US005678336A

United States Patent [19]

Jue et al.

[11] Patent Number: 5,678,336

[45] Date of Patent: Oct. 21, 1997

[54] ILLUMINATED SIGN APPARATUS WITH ARROW-SHAPED SNAP-IN ELEMENTS FOR COVERING ARROW-SHAPED THROUGH-HOLES IN A STENCIL

[75] Inventors: George H. Jue, Hoffman Estates; Gregory L. Kuffel, Schaumburg, both of Ill.

[73] Assignee: Cooper Industries, Inc., Houston, Tex.

[21] Appl. No.: 538,800

[22] Filed: Oct. 3, 1995

[51] Int. Cl.[6] ..... G09F 13/04

[52] U.S. Cl. ..... 40/570; 40/622

[58] Field of Search ..... 40/570, 580, 622; 403/326, 329

[56] References Cited

U.S. PATENT DOCUMENTS

| | | | |
|---|---|---|---|
| 3,289,555 | 12/1966 | Steenberg | 40/622 X |
| 3,402,494 | 9/1968 | Gray . | |
| 3,478,455 | 11/1969 | Fremont . | |
| 3,665,626 | 5/1972 | Lund et al. . | |
| 3,931,689 | 1/1976 | Shine . | |
| 4,355,479 | 10/1982 | Thornton | 40/570 |
| 4,505,061 | 3/1985 | Neuburger et al. | 40/622 X |
| 5,047,907 | 9/1991 | Hawkins | 40/570 X |
| 5,059,058 | 10/1991 | Charet et al. | 403/329 X |
| 5,247,756 | 9/1993 | Johnstone | 40/570 |
| 5,329,717 | 7/1994 | Follis | 40/622 X |
| 5,451,000 | 9/1995 | Shaw et al. | 40/622 X |

*Primary Examiner*—Joanne Silbermann

*Attorney, Agent, or Firm*—Burns, Doane, Swecker & Mathis, L.L.P.

[57] ABSTRACT

An illuminated sign, such as an emergency exit sign, includes a stencil in which a pair of oppositely-directed, arrow-shaped through-holes are disposed. At least one arrow-shaped snap-in element is provided which is inserted into either of the through-holes to block the passage of light therethrough. The snap-in element includes elastic spring fingers having hook-shaped ends adapted to engage a rear end of a ridge which borders a rear side of a respective through-hole, thereby yieldably retaining the snap-in element within the through-hole. All of the spring-fingers are movable simultaneously through a respective through-hole.

14 Claims, 2 Drawing Sheets

FIG. 1
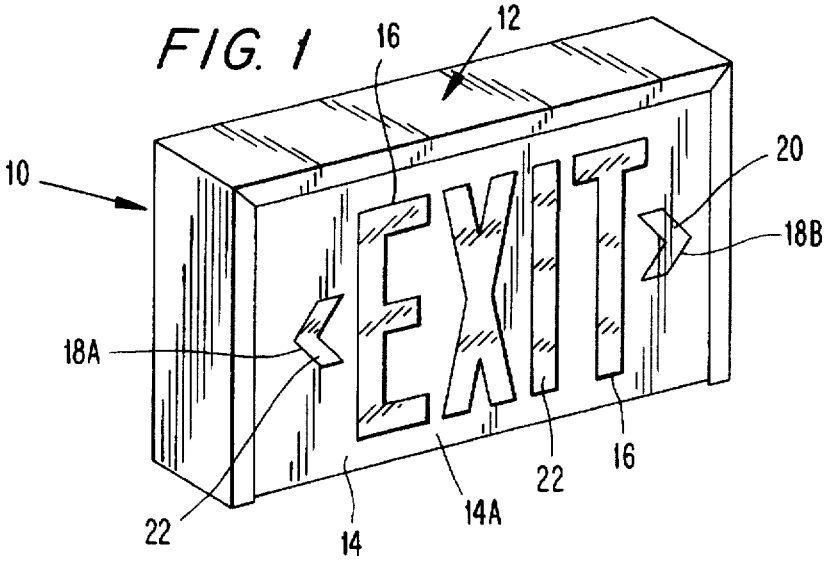
FIG. 2
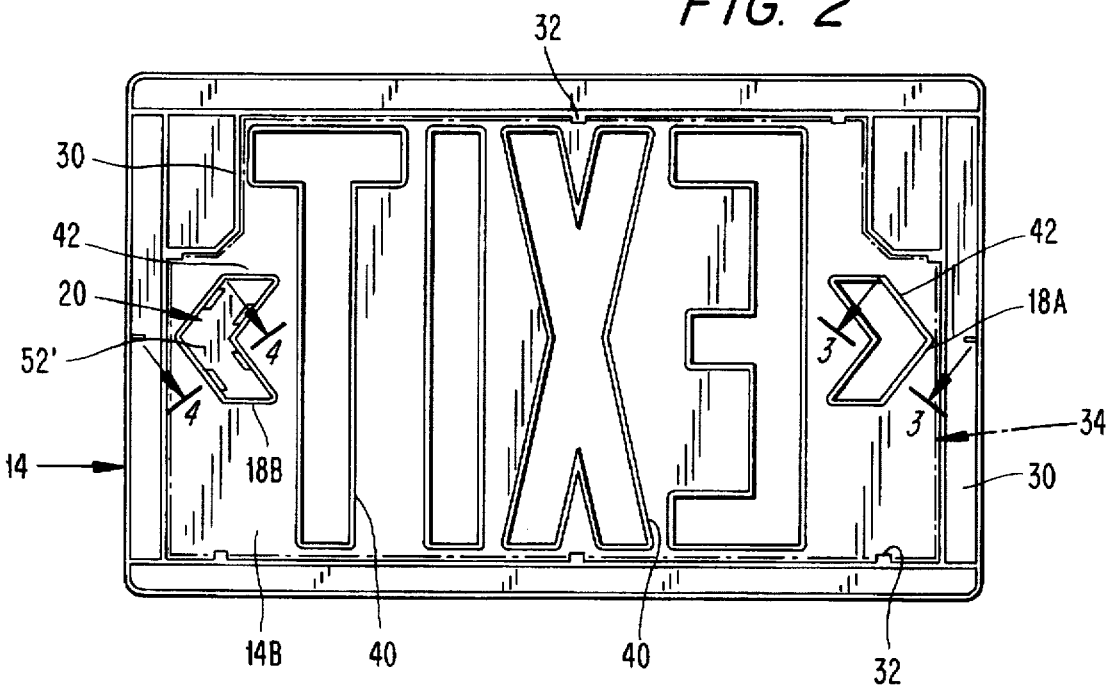
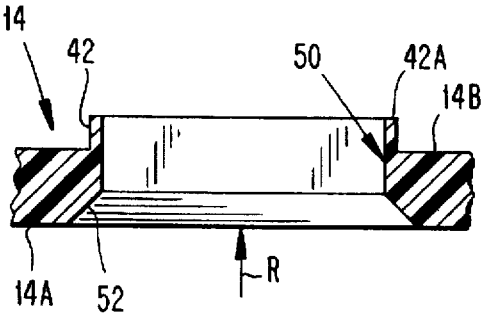
FIG. 3
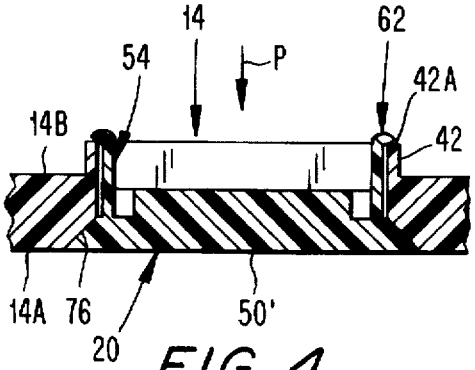
FIG. 4

FIG. 5
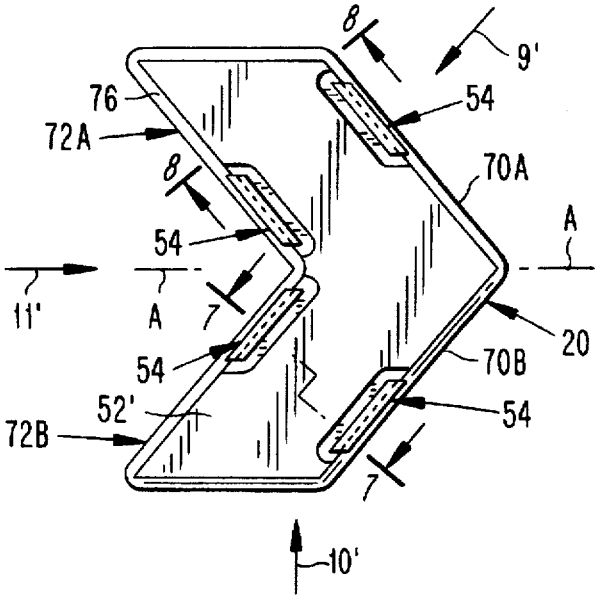
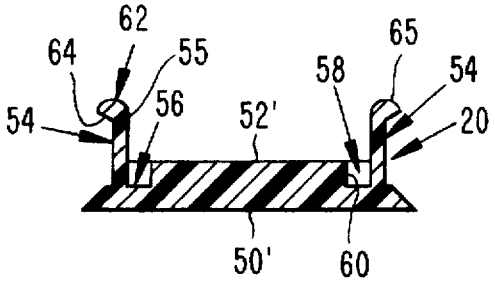
FIG. 7
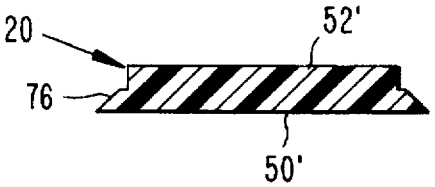
FIG. 8
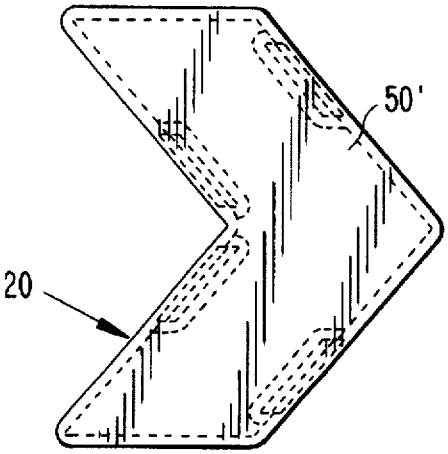
FIG. 6
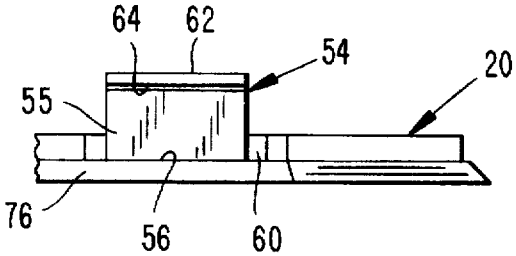
FIG. 9
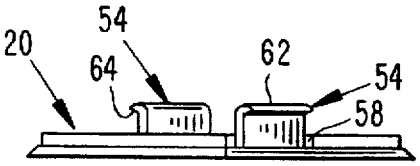
FIG. 10
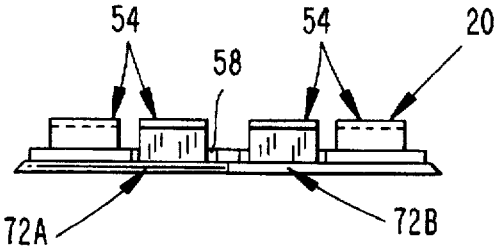
FIG. 11

ILLUMINATED SIGN APPARATUS WITH ARROW-SHAPED SNAP-IN ELEMENTS FOR COVERING ARROW-SHAPED THROUGH-HOLES IN A STENCIL

BACKGROUND OF THE INVENTION

The present invention relates to illuminatable signs, such as exit signs, and in particular to snap-in arrows for use in such signs.

For safety reasons, buildings such as offices and apartments provide illuminated exit signs which indicate the location of the building exits. Thus, in an emergency such as a fire, persons within the building can exit the building more quickly. Such a sign typically comprises a casing which can be hung on a ceiling or wall, and which forms an inner chamber that houses an illumination source (e.g. a bulb or LED units). Covering the front and rear sides of the chamber are main plates, one or both of which is a stencil having through-holes therein shaped to form certain indicia (e.g. "exit"), as well as to form an arrow pointing to the left or right. A diffuser plate is interposed between the stencil and the illumination source to diffuse light of a suitable color (e.g., red) toward the through-holes.

A typical exit sign needs either no arrow, a right arrow, or a left arrow. If a given exit sign were able to satisfy only one of those three requirements, it would be necessary for builders or sign manufacturers to carry a large inventory of signs to satisfy the demand. In order to avoid the resulting large expense and storage capacity, exit signs have been proposed which can be easily modified to point in either the right direction or left direction, or in neither direction, or in both directions. For example, a stencil can be provided with through-holes at right and left sides thereof, and a pair of slides disposed behind respective through-holes. The slides carry suitable arrows and blank portions that can be selectively positioned in alignment with the through-holes to point to either the right or left, or both, or neither (e.g., see U.S. Pat. Nos. 3,665,626 and 3,478,455).

In U.S. Pat. Nos. 3,931,689 and 5,247,756 a stencil is provided with arrow-shaped through-holes and plastic arrow-shaped elements that can be snapped in and out of the through-holes. When installed, the elements block the passage of light. In U.S. Pat. No. 5,247,756 each of the arrow-shaped elements includes a tongue projecting from a rear edge of the element and which is insertable into a notch formed in a rear surface of the stencil. The element also includes a snap rail disposed at a front edge of the element for snapping over a bead formed along the edge of the through-hole. In order to install the element, it is necessary to first insert the tongue into the recess and then pivot the element about a fulcrum defined by the tongue, until the snap rail snaps over the bead. Removal of the element is performed by reversing that sequence of steps. It will be appreciated that if the user performs the steps in improper sequence, e.g., if the user attempts to remove the element by first pushing against the tongue, the tongue could be sheared off. Also, the notch is visible to an observer when the element is not installed, thereby detracting from the appearance of the sign.

It would be desirable to be able to insert and remove a directional element without concern as to performing a proper sequence of steps, and with little risk of shearing-off parts of the element. Also, it would be desirable to provide such an element without detracting from the appearance of the sign.

SUMMARY OF THE INVENTION

The present invention relates to a sign apparatus comprising a housing which forms an illuminatable chamber, and a stencil extending across a side of the chamber. The stencil has front and rear surfaces, and a plurality of through-holes including a pair of oppositely directed arrow-shaped through-holes. The rear surface includes rearwardly projecting ridges bordering respective ones of the arrow shaped through-holes. At least one arrow-shaped snap-in element is provided which is insertable into either of the arrow shaped through-holes. The snap-in element is shaped correspondingly to the arrow-shaped through-holes to block the transmission of light therethrough. The snap-in element includes front and rear faces, and a plurality of spring fingers projecting rearwardly from the rear face. Each spring finger is freely elastically flexible and includes a free end arranged to engage, and be elastically flexed inwardly by, a wall of the arrow-shaped through-hole during installation of the snap-in element. The free end of the spring finger includes a connector engageable with the ridge once the front face of the element becomes substantially flush with the front surface of the stencil, thereby yieldably retaining the snap-in element within its respective arrow-shaped through-hole. All of the spring fingers are movable simultaneously through a respective arrow-shaped through-hole.

Preferably, the free end of the snap-in element is hook-shaped to define the connector. The hook-shaped connector is spaced sufficiently far from the rear face of the snap-in element for springing outwardly past a rear end of the ridge once the front face of the snap-in element becomes substantially flush with the front surface of the stencil.

Preferably, each spring finger is of one piece construction with the rear face, and the rear face preferably includes recesses. Each spring finger projects from a floor of a respective one of the recesses and is spaced from a sidewall structure of its respective recess.

The stencil preferably includes through-holes which form the word exit.

An outer periphery of the front face of the snap-in element forms a stop for terminating installation of the snap-in element once the front face becomes substantially flush with the front surface.

Each ridge preferably extends uninterruptedly around its respective through-hole.

BRIEF DESCRIPTION OF THE DRAWINGS

The objects and advantages of the invention will become apparent from the following detailed description of a preferred embodiment thereof in connection with the accompanying drawings in which like numerals designate like elements and in which:

FIG. 1 is a front perspective view of a sign apparatus according to the present invention;

FIG. 2 is a rear view of a stencil according to the present invention;

FIG. 3 is a sectional view taken along the line 3—3 in FIG. 2;

FIG. 4 is a view similar to FIG. 3 with a snap-in element installed within a through-hole of the stencil;

FIG. 5 is a rear view of a snap-in element according to the present invention;

FIG. 6 is a front view of the element depicted in FIG. 5;

FIG. 7 is a sectional view taken along line 7—7 in FIG. 5;

FIG. 8 is a sectional view taken along line 8—8 in FIG. 5;

FIG. 9 is an edge view of a snap-in element as viewed in the direction of an arrow 9' shown in FIG. 5;

FIG. 10 is an edge view of a snap-in element as viewed in the direction of an arrow 10' in FIG. 5; and FIG. 11 is an edge view of a snap-in element as viewed in the direction of an arrow 11' shown in FIG. 5.

DETAILED DESCRIPTION OF A PREFERRED EMBODIMENT OF THE INVENTION

Depicted in FIG. 1 is an exit sign 10 comprising a casing 12 (e.g., formed of metal) that forms an internal chamber capable of being illuminated by a light source (not shown), such as a lamp or LED units in a conventional fashion. The casing 12 can be attached to a wall or ceiling in a conventional manner. Extending across front and rear sides of the chamber are plates or panels 14 (only one shown in FIG. 1). One or both of those panels comprises a stencil having through-holes 16, 18A, 18B for accommodating the passage of light. The through-holes 16 form the word "Exit", whereas the through-holes 18A, 18B are generally arrow shaped (e.g., chevron-shaped in the preferred embodiment). The arrow 18A points to the left, whereas the arrow 18B points to the right in FIG. 1. Depending upon the location of the exit relative to the exit sign, one, or both, or neither of the arrows 18A, 18B may be illuminated.

For example, if only the arrow 18A is required, it would be uncovered, whereas the arrow 18B would be covered by a cover 20, so that only the arrow 18A would be discernable to a viewer.

Disposed behind the stencil 14 is a light diffusing sheet of material 22 which diffuses light of a suitable color (e.g. red) toward the through-holes in the stencil.

The stencil 14 includes a front surface 14A facing toward the outside, and a rear surface 14B (see FIG. 2) facing toward the internal chamber. As can be seen in FIG. 2, the rear surface 14B includes a pattern of upstanding reinforcing ribs 30 extending around the area containing the through-holes 16, 18A, 18B. Projecting from some of the ribs 30 are tabs 32 which constitute retainers for the diffuser plate, the outer periphery 34 of which is shown in broken lines in FIG. 2. Each of the through-holes 16 which form the word "exit" is bordered by a continuous upstanding ridge 40, and each of the through-holes 18A, 18B is bordered by a continuous ridge 42. The ridges 40, 42 are of shorter height than the ribs 30, so that the diffuser plate is able to fit between the tabs and the ridges.

The side wall 50 of each of the through-holes 18A, 18B is beveled or flared at the front surface 14A to form a continuous inclined surface 52 bordering the front end of each of the through-holes 18A, 18B.

As noted earlier, either or both of the through-holes 18A, 18B is adapted to be covered by an arrow-shaped, snap-in cover element 20 which can be installed in either of the through-holes 18A, 18B. That is, the arrow-shaped elements are of identical configuration and can be installed into either of the through-holes 18A, 18B.

Each snap-in element 20 is shaped correspondingly to the arrow-shaped through-holes 18A, 18B in order to block the transmission of light therethrough once installed. The element 20 includes front and rear faces 50', 52'. Projecting rearwardly from the rear face are spring fingers 54 integrally formed of one piece with the element 20 (see FIG. 7). Each spring finger 54 projects from a floor 56 of a recess 58 formed in the rear face 52, and is spaced outwardly of a sidewall 60 of its respective recess 58 in order to enable the spring finger to flex elastically relative to that sidewall 60.

It will be appreciated that the formation of the recesses 58 serves to increase the length of the spring fingers 54, thereby enhancing the flexibility of the spring fingers.

Each spring finger includes a connector in the form of a generally hooked-shaped free end 62 which forms a shoulder 64 facing generally toward the plane of the front face 50'. The shoulder 64 is slanted such that an outer end thereof is spaced farther from the front face 50' than in the inner end thereof, as shown in FIG. 7.

The element 20 includes a pair of intersecting leading edges 70A, 70B, and a pair of intersecting trailing edges 72A, 72B there are four spring fingers 54 disposed along respective ones of the edges 70A, 70B, 72A, 72B. The element is of symmetrical configuration with respect to a center axis A that passes through both of the intersecting points of the edges 70A, 70B and 72A, 72B.

As can be seen in FIG. 8, the peripheral side edge of the element 20 includes a beveled surface 76 extending completely around the element 20. That surface 76 is adapted to engage a corresponding beveled surface 52 which borders the through-hole 18A or 18B in the front surface 14A of the stencil, when the element 20 has been installed therein. That surface 52 forms a stop which terminates installation of the element 20 once the front face 50' of the element becomes substantially flush with the front surface 14A of the stencil.

Installation of the element 20 is performed in a rearward direction R (see FIG. 3) until the beveled surface 76 of the element 20 contacts the beveled surface 52 of the front surface 14A of the stencil. During such installation, a curved outer face 65 of each spring finger contacts the side wall 50 of the respective through-hole 18A, 18B, and also the associated ridge 42 of the through-hole, and is elastically flexed inwardly, i.e., toward the center of the element 20. The spring fingers are of sufficient length so that when the beveled surfaces 76, 52 contact one another, the spring fingers will be able to snap outwardly to a position where the shoulders 64 overlie a rear end 42A of the respective ridge 42. In this way, the element 20 will be yieldably retained within the through-hole. It can be seen in FIG. 7 that the shoulders 64 are obliquely inclined relative to the plane of the ridge, i.e., relative to the center axis of the respective through-hole, so that a forward pressure P applied against the rear face 52' of the element 20 will cause the spring fingers to be cammed inwardly, enabling the element to be removed from the through-hole.

It will be appreciated from the foregoing that the element 20 can be inserted in such a way that all of the spring fingers 54 travel simultaneously through the respective through-hole. This is in contrast to an arrangement wherein a tongue of an element must be initially inserted into a notch formed in the rear surface, whereupon the rest of the element is pivoted into an installed position, as is known in the prior art. The installation of the present element 20 is simpler, since the element only needs to be pushed rearwardly in the direction R which is parallel to the longitudinal axis of the through-hole.

Furthermore, if the removal of the prior art element is performed by applying pressure against the wrong edge of the element, the tongue may be broken off, rendering the element useless. Such a danger does not exist in connection with the present invention, since the spring fingers may travel through the through-hole simultaneously during removal of the element 20.

It will be also appreciated that the ridges 42 extend continuously (uninterruptedly) around the outer periphery of the hole, rather than being provided with a notch for the reception of a tongue. Such a notch can be visually discernable to a viewer when the respective through-hole is uncovered and illuminated, thereby detracting from the overall appearance of the sign.

Also, by providing four spring fingers to secure the element 20 at four separate locations, the element 20 will be relatively securely and snugly held in the through-hole to effectively block the passage of light.

It will be appreciated that the elements 20 can be installed in either, both, or neither of the through-holes 18A, 18B, and can be removed as necessary.

The stencil 14 and element 20 can be formed of any suitable material, such as metal or plastic.

The present invention can be used with any type of illuminatable sign that uses a stencil.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A sign apparatus comprising a housing forming an illuminatable chamber, and a stencil extending across a side of said chamber; illumination means in said chamber; said stencil having front and rear surfaces and a plurality of through-holes including a pair of oppositely directed arrow-shaped through-holes each bordered by a first beveled surface; said rear surface including rearwardly projecting ridges bordering respective ones of said arrow-shaped through-holes; and at least one arrow-shaped snap-in element insertable into either of said arrow-shaped through-holes; said snap-in element shaped correspondingly to said arrow-shaped through-holes to block the transmission of light therethrough; said snap-in element including front and rear faces, and a plurality of spring fingers projecting rearwardly from said rear face; said front face bordered by a second beveled surface engageable with a respective first beveled surface; each spring finger being freely elastically flexible and including a free end arranged to engage and be elastically flexed inwardly by, a wall of said arrow-shaped through-hole during installation of said snap-in element; said free end including a connector engageable with said ridge once said front face becomes substantially flush with said front surface, for yieldably retaining said snap-in element within its respective arrow-shaped through-hole, all of said spring fingers being movable simultaneously through a respective arrow-shaped through-hole, said free end of each spring finger being hook-shaped to define said connector, said hook-shaped connector being spaced sufficiently far from said rear face for springing outwardly past a rear end of said ridge once said first and second beveled surfaces engage one another, each hook-shaped end including a forwardly facing shoulder for engaging said rear end, said forwardly facing shoulder being slanted such that an outer end thereof is spaced farther from said front face than is an inner end of said shoulder.

2. The sign apparatus according to claim 1, wherein said free end of each snap-in element is hook-shaped to define said connector, said hook-shaped connector being spaced sufficiently far from said rear face for springing outwardly past a rear end of said ridge once said front face becomes substantially flush with said front surface.

3. The sign apparatus according to claim 1, wherein each arrow-shaped through-hole is chevron-shaped and includes a pair of intersecting leading edges and a pair of intersecting trailing edges; each of said leading edges being parallel to a respective one of said trailing edges; there being four said spring fingers disposed along respective ones of said leading and trailing edges.

4. The sign apparatus according to claim 1, wherein there are four of said spring fingers; said spring fingers being of one-piece construction with said rear face; said rear face including four recesses; each spring finger projecting from a floor of a respective one of said recesses and being spaced from a side wall structure of its respective recess.

5. The sign apparatus according to claim 1, wherein said plurality of through-holes includes indicia through-holes arranged to form the word exit.

6. The sign apparatus according to claim 1, wherein an outer periphery of said front face forms a stop for terminating installation of said snap-in element once said front face becomes substantially flush with said front surface.

7. The sign apparatus according to claim 1, wherein each said ridge extends continuously around its respective through-hole.

8. In combination, a stencil adapted to be mounted across an illuminatable chamber of a sign housing, and at least one snap-in element; said stencil having front and rear surfaces of a plurality of through-holes including a pair of oppositely directed arrow-shaped through-holes each bordered by a first beveled surface; said rear surface including rearwardly projecting ridges bordering respective ones of said arrow-shaped through-holes; said at least one arrow-shaped snap-in element being insertable into either of said arrow-shaped through-holes; said snap-in element shaped correspondingly to said arrow-shaped through-holes to block the transmission of light therethrough; said snap-in element including front and rear faces, and a plurality of spring fingers projecting rearwardly from said rear face; said front face bordered by a second beveled surface engageable with one of the first beveled surfaces; each spring finger being freely elastically flexible and including a free end arranged to engage and be elastically flexed inwardly by, a wall of said arrow-shaped through-hole during installation of said snap-in element; each free end including a connector engageable with said ridge once said front face becomes substantially flush with said front surface, for yieldably retaining said snap-in element within its respective arrow-shaped through-hole, all of said spring fingers being movable simultaneously through a respective arrow-shaped through-hole, said free end of each spring finger being hook-shaped to define said connector, said hook-shaped connector being spaced sufficiently far from said rear face for springing outwardly past a rear end of said ridge once said first and second beveled surfaces engage one another, each hook-shaped and including a forwardly facing shoulder for engaging said rear end, said forwardly facing shoulder being slanted such that an outer end thereof is spaced farther from said front face than is an inner end thereof.

9. The combination according to claim 8, wherein said free end of each snap-in element is hook-shaped to define said connector, said hook-shaped connector being spaced sufficiently far from said rear face for springing outwardly past a rear end of said ridge once said front face becomes substantially flush with said front surface.

10. The combination according to claim 8, wherein each arrow-shaped through-hole is chevron-shaped and includes a pair of intersecting leading edges and a pair of intersecting trailing edges; each of said leading edges being parallel to a respective one of said trailing edges; there being four said spring fingers disposed along respective ones of said leading and trailing edges.

11. The combination according to claim 8, wherein each arrow-shaped through-hole is chevron-shaped and includes a pair of intersecting leading edges and a pair of intersecting trailing edges; each of said leading edges being parallel to a respective one of said trailing edges; there being four said spring fingers disposed along respective ones of said leading and trailing edges.

12. The combination according to claim 8, wherein said plurality of through-holes includes indicia through-holes arranged to form the word exit.

13. The combination according to claim 8, wherein an outer periphery of said front face forms a stop for terminating installation of said snap-in element once said front face becomes substantially flush with said front surface.

14. The combination according to claim 8, wherein each said ridge extends continuously around its respective through-hole.

* * * * *